United States Patent [19]

Woehr et al.

[11] 4,148,242

[45] Apr. 10, 1979

[54] SAXOPHONE KEY

[75] Inventors: Theodore P. Woehr, Carnegie; Richard K. Kresic, Elizabeth; James S. Sheppard, Carnegie, all of Pa.

[73] Assignee: Brass and Woodwind Shop, Inc., Carnegie, Pa.

[21] Appl. No.: 854,772

[22] Filed: Nov. 25, 1977

[51] Int. Cl.[2] ..... G10D 7/08

[52] U.S. Cl. ..... 84/385 R

[58] Field of Search ..... 84/380, 385

[56] References Cited

U.S. PATENT DOCUMENTS 1,716,929 6/1929 Packman ..... 84/385

*Primary Examiner*—John Gonzales

*Attorney, Agent, or Firm*—Webb, Burden, Robinson & Webb

[57] ABSTRACT

In a saxophone, a key located adjacent the thumb rest and linked to the B flat key for playing the B♭ note in the lower register with the thumb of the left hand.

4 Claims, 5 Drawing Figures

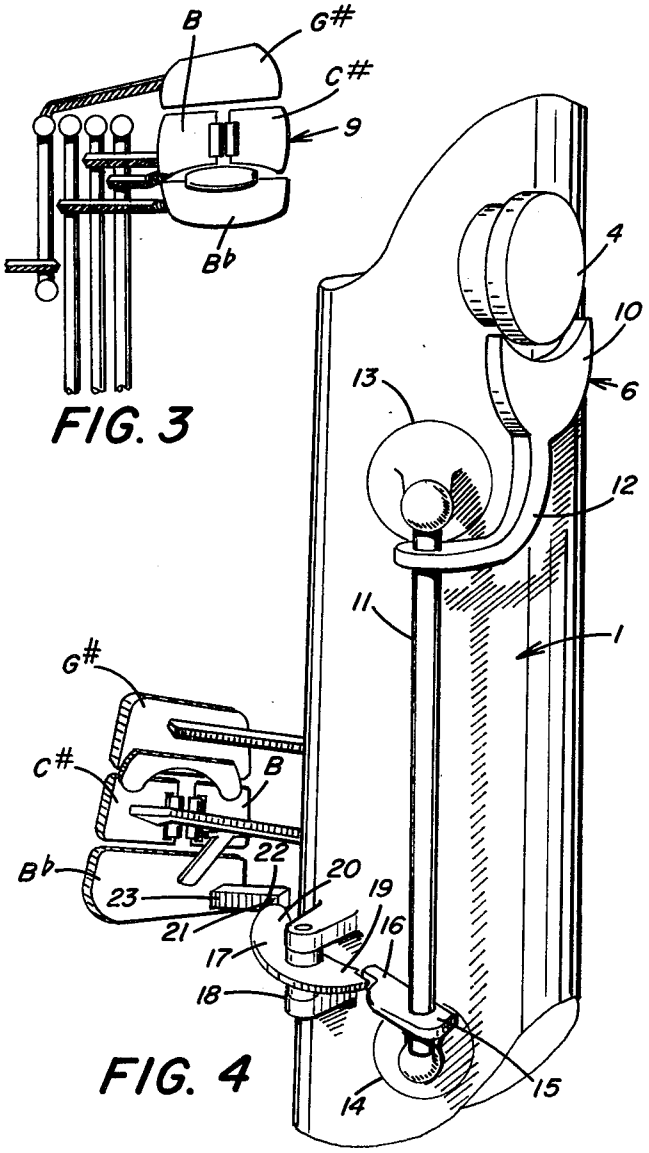
FIG. 3
FIG. 4
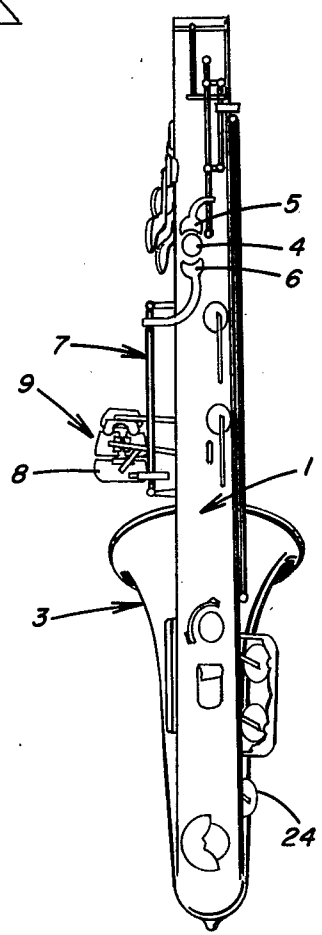
FIG. 2
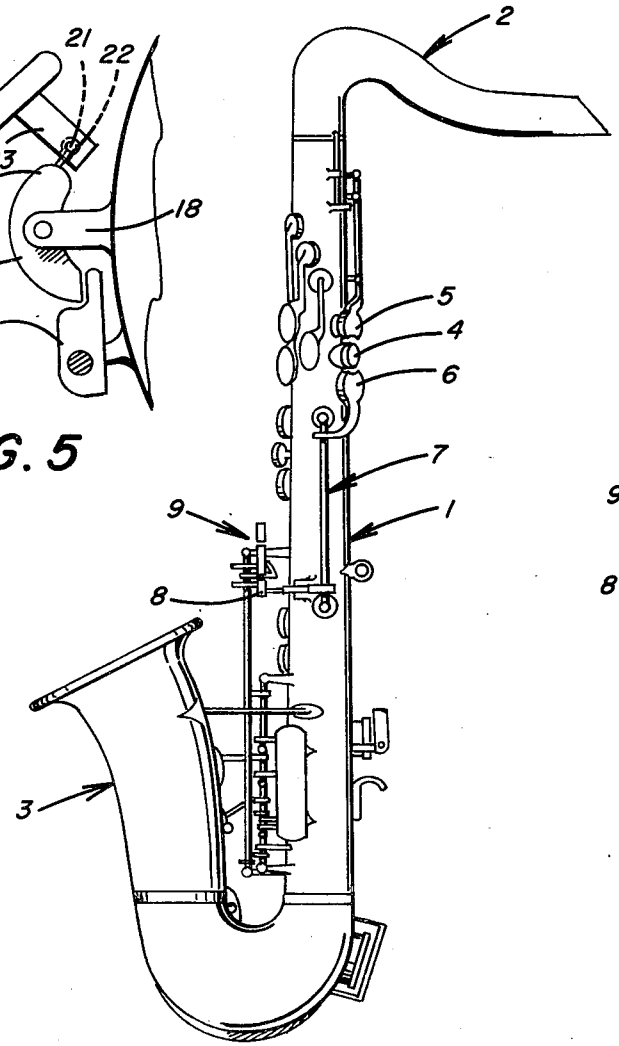
FIG. 1
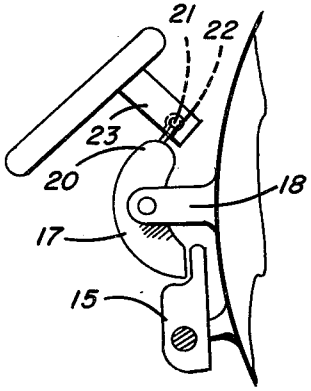
FIG. 5

SAXOPHONE KEY

FIELD OF THE INVENTION

This invention relates to woodwind musical instruments and particularly to a new key for a saxophone which permits the B flat note in the lower register to be played with the thumb of the left hand.

BACKGROUND OF THE INVENTION

In conventional saxophones, the keys for playing the notes G♯, C♯, B and B flat form a cluster played by the fingers of the left hand. More specifically, the B and B flat notes are played by alternately pressing the respective keys with the little finger of the left hand. When playing musical selections requiring a transition between B and B flat, the little finger must slide rapidly and smoothly between two adjacent keys; otherwise an improper sound results. This transition is particularly difficult for beginning saxophonists and, with some selections, for accomplished saxophonists.

Normally the thumb of the saxophone player's left hand is placed on the thumb rest. When playing the upper register, it is used to depress a key adjacent the rest; however, when playing the lower register, it is not used except for support of the instrument.

SUMMARY OF THE INVENTION

We have invented a new key which is located on the body of the saxophone adjacent the thumb rest and which is linked to the B flat key. This new key can be depressed by the thumb of the saxophone player's left hand when playing a selection in the lower register to sound a B flat note, thus avoiding the need to make the difficult transition of the little finger of the left hand from the B to the B flat keys, or vice versa, to sound these notes in succession. However, if desired, the B flat note can be played either with the little finger or the thumb of the left hand.

BRIEF DESCRIPTION OF THE DRAWINGS

In the Figures:

FIG. 1 is an elevation view of a saxophone having our new key and linkage;

FIG. 2 is an elevation view taken 90° to the view shown in FIG. 1;

FIG. 3 is an enlarged partial view of the cluster of keys comprising G♯, C♯, B and B♭;

FIG. 4 is an enlarged partial view of the new key and linkage of the invention; and FIG. 5 is an enlarged partial view of a portion of the linkage of the invention.

BRIEF DESCRIPTION OF A PRESENTLY PREFERRED EMBODIMENT OF THE INVENTION

A conventional saxophone having a body portion 1, mouthpiece portion 2 and horn 3 is shown in FIGS. 1 and 2. Since the invention concerns only a part of the saxophone, only that part will be described in detail hereinafter.

A thumb rest 4 is provided for supporting the saxophone with the left hand. Above the thumb rest (as viewed in FIG. 1) is a key 5 for playing the upper register. On the opposite side of the thumb rest from the key 5 is a new key 6 for playing the B flat note in accordance with the present invention. The key 6 is connected through linkage 7 to the B flat key 8 in the cluster 9 of G♯, C♯, B and B♭ keys (FIG. 3).

Referring to FIG. 4, the new key 6 comprises a thumb portion 10 located adjacent the thumb rest 4 and having a crescent shape for partially encircling the thumb rest so that the thumb of the left hand can be used to depress the key 6 and to support the saxophone. The key 6 is connected to a rod 11 by a curved arm 12 near one end of the rod.

The rod 11 is journaled in supports 13 and 14 which are longitudinally spaced from one another in alignment with the axis of the body portion 1 of the saxophone.

A short leg 15 is secured to the rod near its other end and near support 14. The leg extends outwardly from the rod in the opposite direction from the arm 12 and includes a toe portion 16.

As shown particularly in FIGS. 4 and 5, a crescent-shaped member 17 is journaled between two trunnions 18 mounted on the body 1. One end 19 of member 17 is positioned over toe portion 16 of the leg 15. The opposite end 20 of the member 17 carries an outwardly extending pin 21 which is adapted to engage a hole 22 in leg 23 which is secured to the underside of the B♭ key and extends downwardly therefrom.

OPERATION

To play the B flat note, the musician depresses key 6 adjacent the thumb rest using the thumb of the left hand. Depressing the key causes the rod 11 to rock, lifting the toe portion 16 of the leg 15 causing member 17 with pin 20 in hole 22 to push against leg 23, thus pulling the B♭ key down. As in conventional saxophones depression of the B flat key causes, through appropriate linkage, closure of valve 24 and its pad against the pad cup over the tone hole on the side of the horn 3 of the saxophone.

Having described a preferred embodiment of the invention, it is to be understood that it may be otherwise embodied within the scope of the appended claims.

We claim:

1. In a saxophone, a new key for playing the note B flat in the lower register with the left hand, said key being located adjacent the thumb rest and linked to the B flat key of the saxophone whereby the B flat key can be played either with the little finger or the thumb of the left hand.

2. A new key as set forth in claim 1 comprising a crescent-shaped key for partially encircling the thumb rest whereby the thumb of the left hand can be used to depress the key and to support the saxophone.

3. A new key as set forth in claim 2 wherein the new key is linked to the B flat key by a curved arm connected to a rod journaled in supports longitudinally spaced from one another in alignment with the axis of the saxophone, said rod also carrying a short leg adjacent its opposite end and engageable with means for depressing the B flat key.

4. A new key as set forth in claim 3 wherein the depressing means comprises a member journaled in trunnions located on the body of the saxophone, said member being engageable with said short leg on one end and carrying a pin on the opposite end thereof, and a leg secured to the underside of the B flat key and having a hole therein into which said pin is inserted whereby depression of the new key causes the rod to rotate, lifting the one end of the member and lowering the opposite end, the pin in the hole in the leg pulling down on the B flat key whereby the B♭ note is sounded.

* * * * *